US009487954B2

(12) United States Patent
Narayanan et al.

(10) Patent No.: US 9,487,954 B2
(45) Date of Patent: Nov. 8, 2016

(54) LACED COMPOSITE SYSTEM

(75) Inventors: Anandavalli Narayanan, Chennai (IN); Lakshmanan Narayanan, Chennai (IN); Nagesh R. Iyer, Chennai (IN); Rajasankar Jayachandran, Chennai (IN); Amar Prakash, Chennai (IN)

(73) Assignee: COUNCIL OF SCIENTIFIC & INDUSTRIAL RESEARCH, New Delhi (IN)

( * ) Notice: Subject to any disclaimer, the term of this patent is extended or adjusted under 35 U.S.C. 154(b) by 317 days.

(21) Appl. No.: 14/130,865

(22) PCT Filed: Jul. 5, 2012

(86) PCT No.: PCT/IN2012/000477

§ 371 (c)(1),
(2), (4) Date: Jan. 3, 2014

(87) PCT Pub. No.: WO2013/005232

PCT Pub. Date: Jan. 10, 2013

(65) Prior Publication Data

US 2014/0134395 A1 May 15, 2014

(30) Foreign Application Priority Data

Jul. 5, 2011 (IN) ..... 1886/DEL/2011

(51) Int. Cl.

| | |
|---|---|
| ***E04C 2/28*** | (2006.01) |
| ***E04C 3/293*** | (2006.01) |
| ***E04H 9/04*** | (2006.01) |

(52) U.S. Cl.

CPC ..... *E04C 2/28* (2013.01); *E04C 3/293* (2013.01); *E04H 9/04* (2013.01); *Y10T 428/24033* (2015.01); *Y10T 428/24331* (2015.01)

(58) Field of Classification Search

CPC ..... Y10T 428/24033
USPC ..... 428/223
See application file for complete search history.

(56) References Cited

U.S. PATENT DOCUMENTS 4,454,185 A * 6/1984 Beaumond ..... E04C 5/064 428/121
5,102,723 A * 4/1992 Pepin ..... B32B 7/04 244/133

(Continued)

FOREIGN PATENT DOCUMENTS

| | | | |
|---|---|---|---|
| EP | 1403321 | A1 | 3/2004 |
| EP | 1538273 | A1 | 6/2005 |
| WO | WO-030101726 | A1 | 12/2003 |

*Primary Examiner* — William P Watkins, III
(74) *Attorney, Agent, or Firm* — Blank Rome LLP

(57) ABSTRACT

The present invention relates to a laced composite system with high rotational capacity and ductility which resists the suddenly applied dynamic loads by undergoing excessive plastic deformation, while still maintaining the integrity of the system. The laced composite system comprising, a sandwiched filler material between upper and lower cover plates (1); the said cover plates being provided with the plurality of perforations (2) along the length, plurality of reinforcing members (3) being passed through the said perforations to connect the said cover plates leaving bent edges of the reinforcing members projecting outside the cover plates, plurality of transverse/cross rods (4) being attached at the outer side of the said cover plates through the space available in between the cover plates and bends of the reinforcing members projecting outside the cover plates to hold the said reinforcing members in order to enhance the ductility and rotational capacity of the said laced composite system. This invention has been particularly developed for resisting suddenly applied dynamic loads such as blast, impact, ect.

10 Claims, 4 Drawing Sheets

(56) References Cited

U.S. PATENT DOCUMENTS 5,140,794 A 8/1992 Miller
5,771,648 A 6/1998 Miller et al.
6,090,465 A * 7/2000 Steele ..... B60K 15/03006 264/512
2010/0275547 A1 11/2010 Kamata

* cited by examiner

LACED COMPOSITE SYSTEM

This application is a U.S. national phase of International Application No. PCT/IN2012/000477, filed Jul. 5, 2012, which claims the priority of Indian Patent Application No. 1886/DEL/2011, filed Jul. 5, 2011, the disclosure of which are incorporated herein by reference.

FIELD OF THE INVENTION

The present invention relates to laced composite system.

The present invention particularly relates to a laced composite system which resists the suddenly applied dynamic loads by undergoing excessive plastic deformation, while still maintaining the integrity of the system. This invention has been particularly developed for resisting suddenly applied dynamic loads such as blast, impact, etc.

BACKGROUND OF THE INVENTION

Prior art reference may be made to U.S. Pat. No. 6,871,462 titled "Composite action system and method" wherein a composite structural system consisting of plates welded to the steel beam and transverse reinforcing members passing through the apertures/perforations in the plates and additional reinforcing members positioned parallel and transverse to the structural members to provide an interlocking composite action between the structural members, reinforcing members, and concrete. The drawback of this system is that it is only suitable for bridge decks or floor slabs, where steel beams are used over which concrete slabs can be cast.

Reference may also be made to www.bi-steel.com wherein a Corus-patented construction material is described. Bi-Steel comprises two steel plates that are permanently connected together to form panels by an array of friction welded transverse bars. These panels are then filled with concrete to create a construction material with outstanding strength. This system has been used in blast resistant construction. The drawback of this system is that it requires welding and minimum spacing between the plates is 200 mm.

A further prior art reference may be made to U.S. Pat. No. 5,426,903 titled "Weld-on dowl for a steel/concrete composite construction", wherein a Metal weld-on dowel for steel/concrete composite constructions, which has at one end, a weld-on end and at the other end a head for anchoring in the concrete is described. For improving the load-carrying behavior in the case of shear loading, at the weld-on end the shank has a portion with an increased cross-section compared with the shank. The drawback of this system is that it requires welding and there is only discrete connection between the steel plates.

Reference may also be made to U.S. Pat. No. 5,797,235 titled "Double skin composite structures" wherein a connector which provides a joint between two double skin composite panels of a structure and each double skin composite panel comprises a pair of metal icing plates joined together by a plurality of cross-members and filled, at least partially, with a cementitious filler material. The drawback of this system is that the connecting members are welded to the plates and the transfer of shear is at discrete locations.

When a structure is subjected to suddenly applied dynamic loads, an elastic design is seldom possible. Allowing the structure to undergo plastic deformations without losing the integrity is essential to arrive at an economical design. Therefore, ductility and structural integrity are essentially required for structures subjected to suddenly applied dynamic loads. Common construction material concrete, which is normally brittle, is reinforced suitably with steel bars to form laced reinforced concrete (LRC), which enhances the ductility and integrity and which has been successfully used in construction of structures subjected to suddenly applied dynamic loads such as blast. However, LRC construction is complex due to congestion of reinforcement. Also, concrete confined within the reinforcement grill is only effective. Moreover, interpretation of construction drawing needs skilled personnel. Possibility of incorrect interpretation leads to erroneous construction. This difficulty has created interest in developing a simpler structural system, which has properties required for construction of structures resisting suddenly applied dynamic loads. Steel-concrete composite (SCC) system is utilizes the advantages of the both the materials, namely, steel and concrete, efficiently. Bi-steel connector has been used in blast resistant construction, but has the drawback of minimum required spacing between the plates as 200 mm and requires welding. As a consequence to the hitherto known prior art as described herein above, it is clear that there is a need for developing an alternative and simpler structural system which has properties required for resisting suddenly applied dynamic loads, namely, ductility and structural integrity. In this invention, laced composite system is developed, which is simpler and user friendly structural system with improved ductility, which maintains structural integrity even after attaining large deformation, which is essential in resisting suddenly applied dynamic loads, and avoids welding.

OBJECTS OF THE PRESENT INVENTION

The main object of the present invention is to provide laced composite system, which obviates the drawbacks of the hitherto known prior art as detailed above.

Another object of the present invention is to provide laced composite system, which possess large rotational capacity/ductility and maintains structural integrity.

Still another object of the present invention is to provide laced composite system, which may be useful in resisting suddenly applied dynamic loads such as blast, impact, earthquake, etc.

Yet another object of the present invention is to provide laced composite system with unique novel way of connecting the plates, which avoid welding.

SUMMARY OF THE INVENTION

In the present invention, the laced composite system, with its large rotational capacity is able to resist the suddenly applied dynamic load effectively. This laced composite system of the present invention consists of cover plates provided with apertures/perforations, which are connected in a novel way using reinforcing members and transverse/cross rods and filled with a filler material. Reinforcing members are held in position with help of transverse/cross rods, which is essential for the expected performance of the panel. This novel method of connection totally avoids welding. Reinforcing members consist of continuously bent rods, which transfer the shear continuously as against the discrete transfer of shear in other forms of connectors.

BRIEF DESCRIPTION OF THE DRAWINGS

The laced composite system of the present invention is illustrated in FIGS. 1 to 4 of the drawing(s) accompanying this specification.

DETAILED DESCRIPTION OF THE INVENTION

Figure 1:
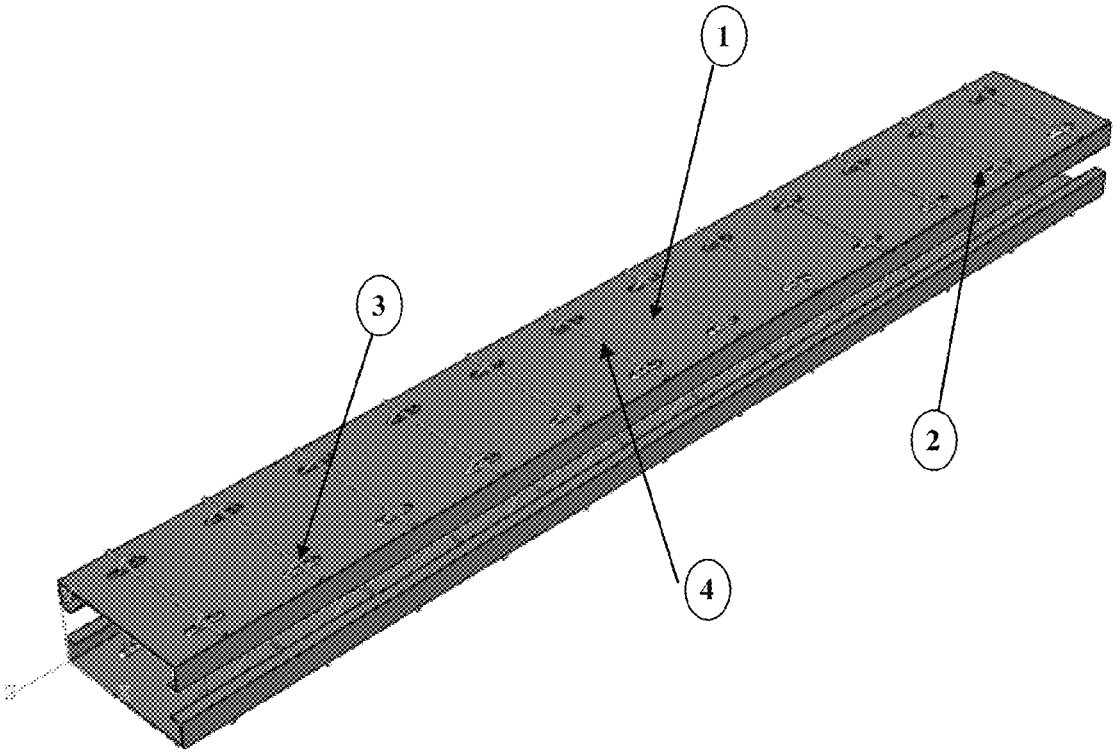
FIG. 1 of the drawings accompanying this specification depicts an isometric view of the assembled metal part of the composite panel of the present invention. In this figure, part no. 1 is upper and lower cover plates (1), which has apertures/perforations (2) for reinforcing members (3) to pass through. No. 4 is transverse/cross rods which hold the reinforcing members in place. Reinforcing members (3) are taken in between apertures/perforations (2) and transverse/cross rods (4) are inserted above the cover plates (1). Reinforcing members ensure continuous transfer of shear, which increases the ductility of the panel.
Figure 2:
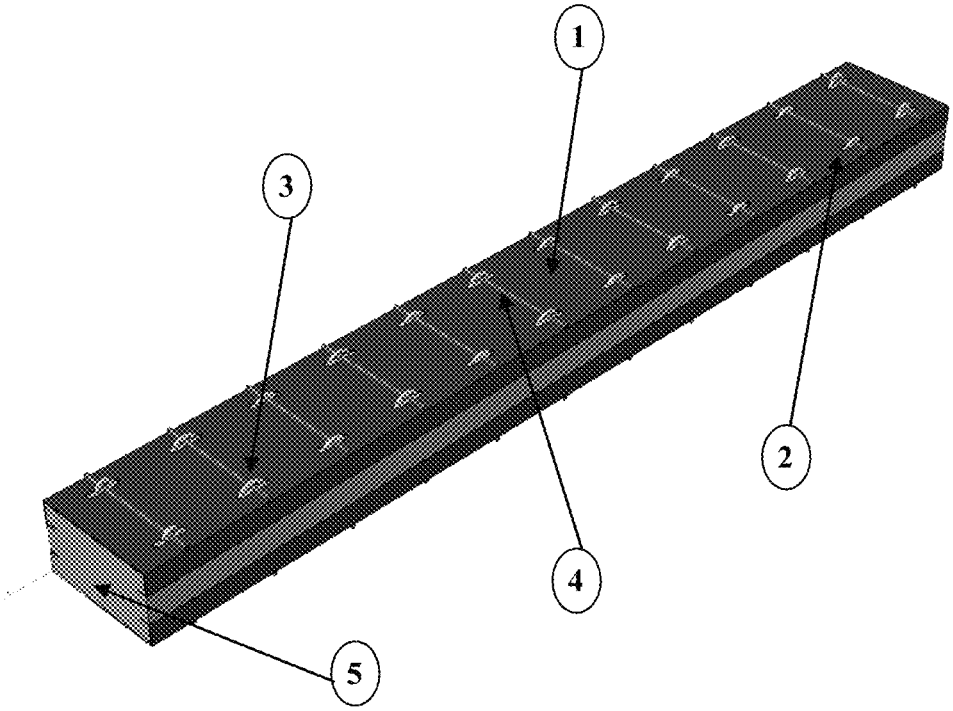
FIG. 2 of the drawings accompanying this specification depicts shows the completed system after filling with filler material, which is represented in this figure as part no. 5. Filler material is essential for transfer of forces and also adds to the mass, which is an essential requirement in resisting suddenly applied dynamic loads.

Accordingly the present invention provides a laced composite system comprising, a sandwiched filler material between upper and lower cover plates (1); the said cover plates being provided with the plurality of perforations (2) along the length, plurality of reinforcing members (3) being passed through the said perforations to connect the said cover plates and leaving bent edges projecting outside the cover plates, plurality of transverse/cross rods (bars) (4) being attached at the outer side of the said cover plates through the space available in between the cover plates and bends of the reinforcing members projecting outside the cover plates to hold the said reinforcing members in order to enhance the ductility and rotational capacity of the said laced composite system.

In an embodiment of the present invention, the length to breadth ratio of the cover plate is preferably 8:1.

In an embodiment of the present invention, the length of the transverse/cross bar is equal to the width of reinforcing member so as to cover a wide range of spans and boundary conditions.

In an embodiment of the present invention, the diameter of the transverse/cross bar is equal to or higher than that of the diameter of the reinforcing member and spacing of cross bars is such that it controls the buckling of the cover plate and can be utilized for two way action as well.

In another embodiment of the present invention the spacing of the cross bar depends on the angle of the reinforcing member.

In an embodiment of the present invention, the filler material used is selected from a group of concrete or recyclable material or cementitious material.

In an embodiment of the present invention, the cover plate used is selected from a group of metals such as steel, aluminum etc.

In an embodiment of the present invention, the ductility factor of the system is in the range of 8 to 12.

In an embodiment of the present invention, the rotational capacity of the system is in the range of 10° to 12° at support with post-peak load drop restricted to 25%.

In an embodiment of the present invention, continuously bent reinforcing members are used so as to provide continuous transfer of shear through the system.

In still another embodiment of the present invention in one plane, there are two number of reinforcing member which are continuously bent. In alternate perforation the same reinforcing member will be present.

In an embodiment of the present invention, the system is used in construction of structures so as to resist sudden applied dynamic load.

In an embodiment of the present invention, the applied dynamic load is in the range of 150-180 kN.

In an embodiment of the present invention, there are cover plates provided with plurality of apertures/perforations, whose thickness and spacing between them can vary depending on the required capacity.

In another embodiment of the present invention, reinforcing members which are continuously bent are provided, whose diameter can vary depending on the shear to be transferred. This new method of connecting the plates using reinforcing members ensures integrity of the panel even at very high support rotation and also transfer of forces between the plates is achieved.

In yet another embodiment of the present invention, transverse/cross rods of diameter higher than that of reinforcing members are provided and of length equal to width of the system so as to reduce the unsupported length and to increase the local buckling capacity. This ingenious way of integrating plates and reinforcing members enhances the performance of the system.

In still another embodiment of the present invention, filler material is infilled with between the cover plates, which is essential for transfer of forces and to add to the mass, which is essential to resist suddenly applied dynamic loads. Filler material can be concrete, recyclable material. Matrix can be with or without addition of other materials such as fibers, fly ash etc.

In the laced composite system of the present invention, cover plates are provided with plurality of apertures/perforations of size to accommodate the reinforcing members at the bents. These cover plates are placed at distance apart and reinforcing members are taken in between the cover plates and pass through the aperture, leaving the bent edges of reinforcing members to project outside the cover plates. Transverse/cross rods are inserted on the outer sides of the cover plates through the space available in between the cover plates and bents in the lacing. Filler material is filled in between to form the system.

Cover plates are made of material which is continuous and which possess high post buckling capacity. Reinforcing members are used to connect the cover plates instead of the conventional shear connectors such as headed stud connector, through-through connectors. This is due to the reason that, in case of reinforcing members in the present invention, there is continuous transfer of shear as against discrete transfer in case of conventional shear connectors. This enhances the rotational capacity of the system. In this invention, welding is avoided to connect the reinforcing members to cover plates by using transverse/cross rods; This has helped in enhancing the ductility/rotational capacity of the system, while in case of welding there is possibility of detachment of components at welding locations.

Performance of laced composite system is based on the principle that if there is continuous transfer of shear, the rotational capacity of the component increases as against discrete transfer. Continuous transfer of shear is ensured in the present invention by providing reinforcing members. As a result, the rotational capacity of the system is increased enormously. Ingenious way of connecting the reinforcing members to the plates using transverse/cross rods, has further enhanced the performance of the panel.

The following examples are given by way of illustration of the working of the invention in actual practice and therefore should not be construed to limit the scope of the present invention.

EXAMPLE-1

Figure 3:
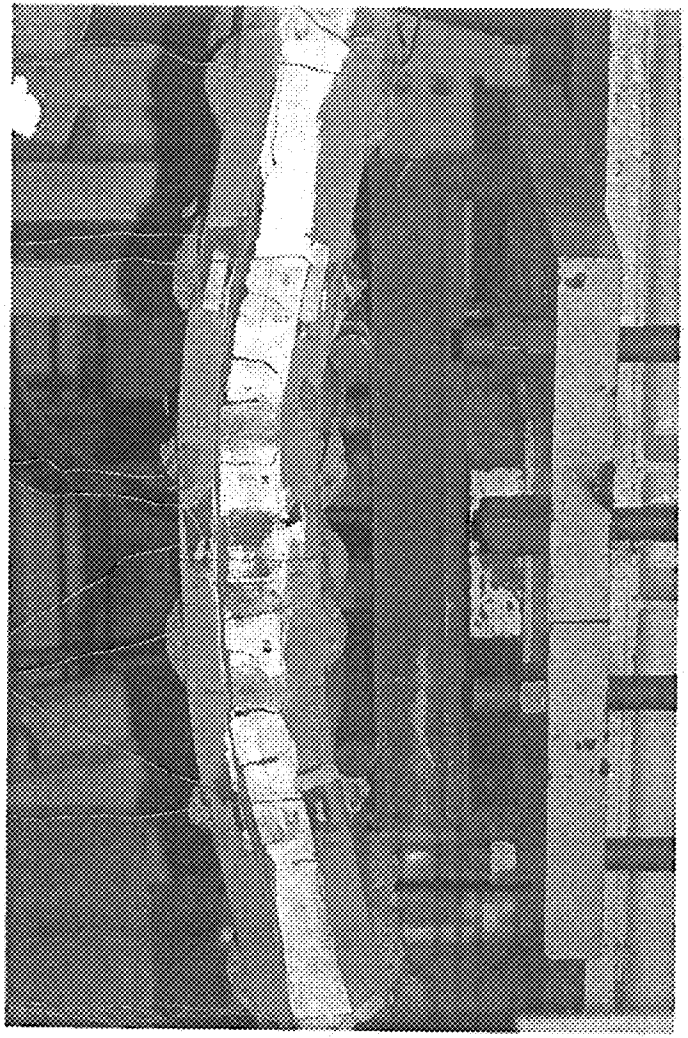
FIG. 3 of the drawings accompanying this specification depicts an experiment on laced composite system.

An experiment on laced composite system as depicted in FIG. 3 is carried out using a prototype of the present invention as shown in FIG. 1 of the drawings. Diameter of the reinforcing members is calculated based on the shear to be transferred. Spacing between the cover plates is kept as 150 mm, while thickness is 3 mm. Transverse/cross rods (bars) are of 10 mm diameter and length 300 mm. The support rotation of more than 10° is achieved, while the system still is able to sustain considerable .percentage of peak load. In this case, local buckling of the top plate is observed before the peak load is achieved. Post peak drop in load is less amounting to only 9.5%, even after exhibiting a very high ductility factor of more than 10.

EXAMPLE-2

Figure 4:
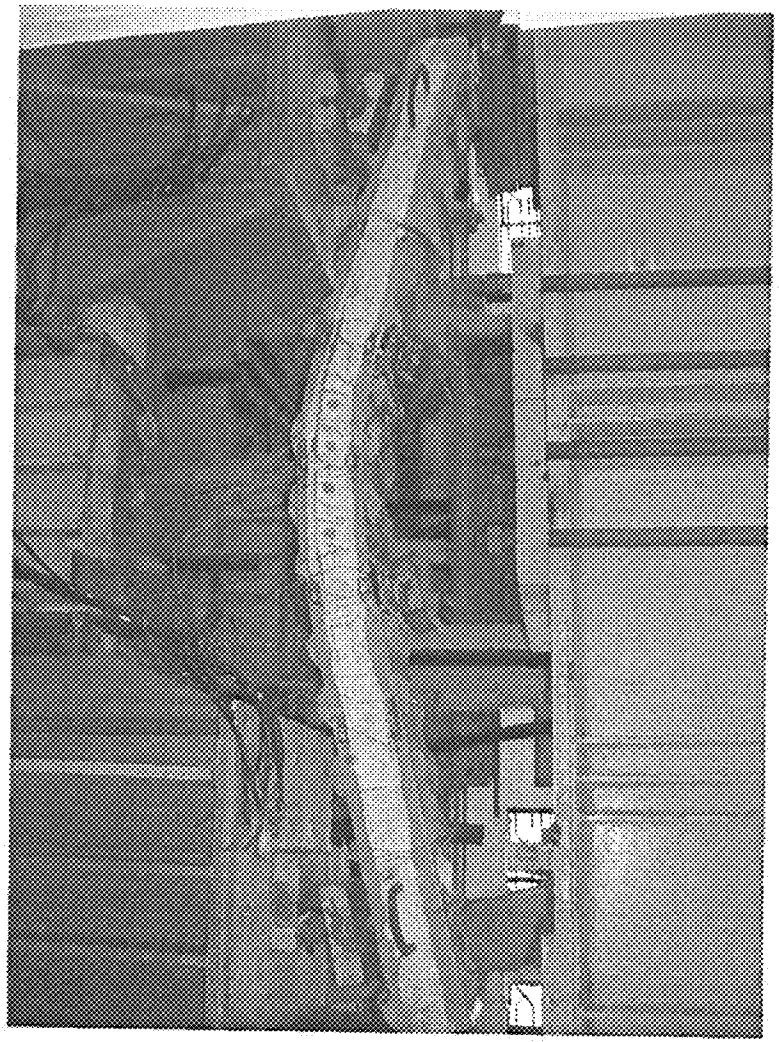
FIG. 4 depicts a prototype of the present invention.

Another experiment on laced composite system is carried out as depicted in FIG. 4 using a prototype of the present invention as shown in FIG. 1 of the drawings. In this example, the angle of reinforcing members is changed, while all other parameters are kept as in Example-1. Top plate buckled locally, after the peak load is attained. This local buckling induced drop in load of about 20%. System is able to sustain at nearly the peak load even after attaining a support rotation of more than 10°. A very high ductility factor of more than 10 is achieved with only about 20% post peak load drop.

Novelty of the present invention lies in enhanced ductility and large rotational capacity of the laced composite system, with which it resists the suddenly applied dynamic loading effectively. Non-obviousness of the present invention lies in the way of connecting the cover plates using reinforcing members and transverse/cross rods, which has resulted in the enhanced performance.

ADVANTAGES

The main advantages of the present invention are:

1. Provides a laced composite system with high rotational capacity and ductility.
2. Facilitates integration of multiple units to form large structural components.
3. Avoids welding in total.
4. Can be used in construction of structures which resist suddenly applied dynamic loads such as blast, impact, earthquake, etc.
5. Uses minimum material effectively.
6. Possess high quality control, due to prefabrication of part of the system in factory
7. Can be installed rapidly

The invention claimed is:

1. A weld free laced composite structural system for resisting suddenly applied dynamic loads consisting essentially of a filler material having a substantial mass and suitable for the transfer of forces;

an upper cover plate and a lower plate placed at a distance apart and made of material which is continuous and which possesses high post buckling capacity, the filler material being sandwiched between the upper and lower cover plates, said cover plates being provided with a plurality of perforations along a first direction;

a plurality of continuous reinforcing members consisting of continuously bent rods extending in said first direction and passing through said perforations to connect said cover plates with bent portions of said continuous reinforcing members projecting outside each of the cover plates; and a plurality of transverse/cross rods extending in a second direction transverse to said first direction, the transverse/cross rods being inserted at an outer side of said cover plates through the space available between the cover plates and said bent portions of the continuous reinforcing members projecting outside the cover plates to hold said continuous reinforcing members, thereby avoiding welding and enhancing the ductility and rotational capacity of said laced composite structural system, wherein the rotational capacity of the system is in the range of 10° to 12°.

2. The laced composite system as claimed in claim 1, wherein the diameter of cross bar is equal to or higher than that of the diameter of the reinforcing member and spacing of cross bar is such that it controls the buckling of the cover plate and can be utilized for two way action as well.

3. The laced composite system as claimed in claim 1, wherein the filler material used is selected from a group consisting of concrete or recyclable material or cementitious material.

4. The laced composite system as claimed in claim 1, wherein the cover plates used are metals selected from a group consisting of steel and aluminum.

5. The laced composite system as claimed in claim 1, wherein the ductility factor of the system is in the range of 8 to 12.

6. The laced composite system as claimed in claim 1, wherein the rotational capacity of the system is in the range of 10° to 12° at support with post-peak load drop restricted to 25%.

7. The laced composite system as claimed in claim 1, wherein the reinforcing members are used so as to provide continuous transfer of shear through the system.

8. The laced composite system as claimed in claim 1, wherein the reinforcing members consist of continuously bent rods.

9. The laced composite system as claimed in claim 1, wherein the system is used in construction of structures so as to resist sudden applied dynamic load in the range of 150-180 kN.

10. The laced composite system as claimed in claim 1, wherein the length of the cross bar is equal to the width of the system.

* * * * *